United States Patent [19]

Albert

[11] Patent Number: 4,537,658

[45] Date of Patent: Aug. 27, 1985

[54] PAPERMAKERS FABRIC CONSTRUCTED OF EXTRUDED SLOTTED ELEMENTS

[75] Inventor: Hans Albert, Vienna, Austria

[73] Assignee: Scapa Inc., Waycross, Ga.

[21] Appl. No.: 429,154

[22] Filed: Sep. 30, 1982

[51] Int. Cl.[3] ..... D21F 1/10

[52] U.S. Cl. ..... 162/348; 162/351; 162/DIG. 1; 198/850

[58] Field of Search ..... 162/348, 350, 351, 358, 162/DIG. 1; 198/850, 851, 821

[56] References Cited

U.S. PATENT DOCUMENTS

| | | | |
|---|---|---|---|
| 500,521 | 6/1893 | Wickers | 198/850 |
| 1,663,298 | 3/1928 | Geer et al. | 162/DIG. 1 |
| 2,775,338 | 12/1956 | Schmalzried | 198/850 |
| 3,121,660 | 2/1964 | Hall, Jr. | 162/DIG. 1 |
| 3,262,549 | 8/1964 | Stewart et al. . | |
| 3,349,893 | 2/1965 | Jordan et al. . | |
| 3,451,526 | 3/1967 | Fernandez . | |
| 3,680,927 | 8/1972 | Neurether | 198/850 |
| 4,016,971 | 4/1977 | Komossa et al. . | |
| 4,084,687 | 4/1978 | Lapeyre . | |
| 4,170,281 | 10/1979 | Lapeyre . | |
| 4,206,258 | 6/1980 | Balcar | 162/358 |

*Primary Examiner*—Steve Alvo

*Attorney, Agent, or Firm*—Fleit, Jacobson, Cohn & Price

[57] ABSTRACT

A papermakers fabric for use in papermaking and which is made from a plurality of elongated, linked, slotted elements. The elongated elements can be formed by extrusion or by lamination and are linked one to the next either by an integral tongue or through the use of a pintle connecting means which extends from one elongated element to the adjacent element. The desired permeability can be provided by forming apertures in the elongated elements and can be such that the permeability of the fabric varies in the cross machine direction. The permeability of the papermakers fabric can also be adjusted by varying the tension in the fabric in the machine direction. Individual elongated elements can also be configured so that the high-wear areas of the fabrics, for example the edges, have a greater material thickness than the low-wear areas and so that the cross section of the fabric can be varied to compensate for roll crown or other roll irregularities.

14 Claims, 12 Drawing Figures

NORMAL TENSION

←HIGH TENSION→

PAPERMAKERS FABRIC CONSTRUCTED OF EXTRUDED SLOTTED ELEMENTS

BACKGROUND OF THE INVENTION

1. Field of the Invention

The present invention relates to a papermakers fabric for supporting and conveying fibrous webs through papermaking processes and more particularly to a papermakers fabric formed from a plurality of extruded slotted elements.

2. Description of the Prior Art

In papermaking machines, a papermakers fabric in the form of an endless belt-like structure is supported on and advanced by various machine rolls during the papermaking process. Papermaking fabrics carry various names depending on their intended use. By way of example, papermakers fabrics include forming fabrics, wet press felts, and dryer felts and fabrics, to name a few.

Forming fabrics, for example fourdrinier wires, or forming media, are commonly configured from a length of woven fabric with its ends joined together in a seam to provide an endless belt. The fabric may also be constructed by employing an endless weave process, thereby eliminating the seam. Either fabric generally comprises a plurality of machine direction yarns and a plurality of cross machine direction yarns which have been woven together on a suitable loom.

Recently, in the papermaking field, it has been found that synthetic materials may be used in whole or in part to produce forming fabrics of superior quality. Today, almost all forming fabrics are made from polyesters, such as Dacron or Trevira, acrylic fibers, such as Orlon, Dynel, and Acrylan, copolymers such as Saran, or polyamides, such as Nylon. The warp and weft yarns of the forming fabric may be of the same or different constituent materials and construction, and may be in the form of a monofilament or multifilament yarn.

Among the problems encountered in conventionally woven forming fabrics is edge curling and the trade-off between fabric strength and stability on the one hand and permeability on the other.

A conventional dryer felt consists of a woven endless conveyor belt made from a two- or three-plane fabric wherein the various planes are defined by different groups of cross machine direction yarns. The planes, plys or layers are united by a plurality of machine direction yarns. The yarns used to weave the most up-to-date dryer felts are made from synthetic monofilaments or synthetic multifilaments, from such materials as polyester or polyamide.

A further disadvantage of the woven papermakers belts is that there is no easy way to repair a damaged belt. Typically, if a papermakers belt is damaged in use, it must be replaced in its entirety.

Extruded synthetic elements have been used to form conveyor belts used in various material handling applications involving heavy, bulky articles. The extruding process provides a method of manufacture which is easy and inexpensive. Structural elements resulting from the extrusion process are then linked together one to the next, or by means of pintles, to form a strong, resilient belt.

Although the use of joined extruded elements is known in the field of conveyor belts, such belts have not been used in papermaking because they have not had the requisite characteristics for supporting and conveying wet, relatively fragile paper and fibrous webs. For example, many conveyor applications require that the article-contacting surface of the belt have ridges or other protrusions to provide gripping means to help hold the material on the belt. In contrast, in papermaking operations the surface of the papermakers belt must be smooth in order to minimize paper marking problems and to impart a smooth surface to the paper sheet. Current methods of joining extruded slotted elements typically leave a gap between one element and the next; such an arrangement would tend to produce paper with significant and undesirable markings caused by these joints. Additionally, such gaps permit the accumulation of dirt and foreign matter which could be transferred to the surface of the paper web.

A further disadvantage of the extruded conveyor belts used in material handling applications is the lack of controlled permeability of the blets. The papermaking process involves the removal of large amounts of water from the fiber-water slurry in the forming stage, and requires significant moisture transfer through the dryer fabrics used in the drying sections of such machines. Current extruded elements formed from synthetic materials are typically impermeable.

There is thus a need for a papermakers fabric which can function reliably in the various environments encountered during the papermaking process while at the same time being capable of being produced inexpensively and efficiently. It is also desirable that the papermakers fabric be endless in construction, have acceptable permeability, and be easily repaired while in position on a papermaking machine. The present invention is directed toward meeting those requirements.

SUMMARY OF THE INVENTION

Briefly stated, in accordance with one aspect of the present invention a papermakers fabric is provided which generally includes a plurality of formed, elongated elements linked together one to the next to form an endless fabric. Defined throughout the fabric are a series of drainage apertures which are created in each of the elongated elements to provide the desired permeability and drainage. The elongated elements are provided in a form that will allow linking to create an endless fabric by means provided in the form of slots in the edges of the elongated members to permit linking adjacent members together.

It is thus a primary objective of the present invention to provide an improved papermakers fabric which can be easily and economically manufactured.

It is a further object of the present invention to provide a papermakers fabric that can be rapidly repaired while in position on a papermaking machine in order to reduce machine down time and to conserve belt material.

It is a further object of the present invention to provide a papermakers fabric in which permeability may be easily and economically controlled.

It is a still further object of the present invention to provide a papermakers fabric with improved wear characteristics for a longer life.

It is another object of the present invention to provide a papermakers fabric which is quicker and easier to seam together in a repeatable and uniform fashion.

These and other objects and advantages will become more apparent when reference is made to the following detailed description of a preferred embodiment and the drawings referred to therein.

DESCRIPTION OF THE PREFERRED EMBODIMENTS

Figure 1A:
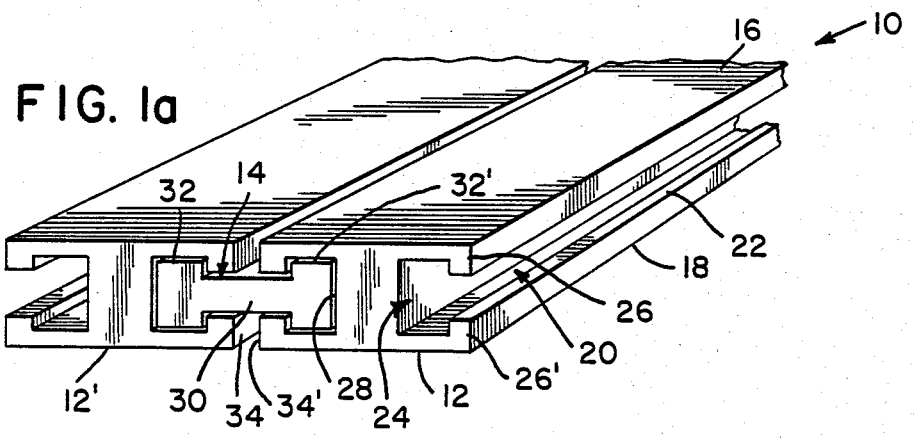
FIG. 1A is a fragmentary perspective view of one form of a papermakers fabric formed from extruded, slotted elements in accordance with the present invention.

In describing the preferred embodiments of the invention illustrated in the drawings, specific terminology will be resorted to for the sake of clarity. However, the invention is not intended to be limited to the specific terms so selected and it is to be understood that each specific term includes all technical equivalents which operate in a similar manner to accomplish a similar purpose.

Referring first to FIGS. 1A through 1D, which show several embodiments of the present invention, FIG. 1A illustrates a section of an endless papermakers fabric, shown generally at 10, formed according to the present invention. Extruded elements 12 and 12' are shown connected by pintle 14.

Each of extruded elements 12, 12' is similarly configured and is formed from laminated or solid plastic, or laminated synthetic rubber, depending upon its intended use, although it could be formed from other materials, such as metals. Each element is of generally rectangular cross section and is of sufficient length to fit the width required on the particular papermachine on which it will be used. Parallel top and bottom surfaces 16 and 18, respectively, form the two long flat faces of the rectangulars cross section, with upper surface 16 defining a smooth, paper bearing surface. Into each of the shorter sides of elements 12, 12' a T-shaped slot 20 is formed comprising a narrow outer groove 22, which can be at the midpoint of the short sides of slotted element 12, if desired, and a generally rectangular, widened inner groove portion 24. T-shaped slot 20 includes opposed faces 26 and 26' which will serve to constrain the pintle in the machine direction, as will hereinafter be described. On the opposite shorter side of the extruded element a second slot 28 is formed to be symmetrical to and of precisely the same dimensions as the first slot 20.

Pintle means 14 can also be formed as an extruded element. The H-shaped pintle shown includes a narrow central portion 30 and two T-shaped, wider end portions 32 and 32', which are of a size to permit them to be received in and to closely fit the T-shaped slots 20 and 28. Central portion 30 is of such a length that the upper surfaces of the adjacent slotted elements are held in close abutment.

The assembly of the endless papermakers fabric of the present invention is accomplished by placing two extruded slot elements 12 and 12' next to each other so that the adjacent side surfaces 34 and 34' are aligned in a manner that will allow pintle 14 to be inserted between them. Pintle 14 is then inserted from the side so that the T portions of the pintle engage the respective T-shaped slots in each of the extruded elements. Gluing, melting, welding, deforming the ends thereof, or, in some cases bolting, can be used to hold the pintle in place and keep it from sliding laterally outwardly of the fabric.

Figure 1B:
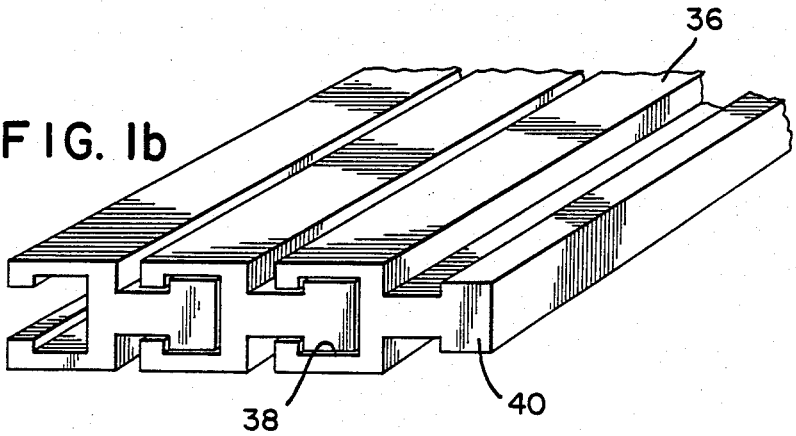
FIG. 1B is a fragmentary perspective view of another embodiment of a papermakers fabric in accordance with the present invention.

FIG. 1B shows an alternate embodiment of the present invention which does not require a separate pintle element for linking adjacent slotted elements. Each of the slotted elements 36 contains a T-shaped slot 38 on one edge and T-shaped tongue 40 on the opposite edge. The slots 38 and tongues 40 can be formed in a shape similar to slots 20 and pintle 14 described above and shown in FIG. 1A. Tongue 40 is shaped to fit tightly within slot 38 to provide a secure linkage between adjacent elements. Assembly of the slotted element papermakers belt according to this embodiment involves sliding the slot of one element over the T-shaped tongue of its adjacent element and then gluing, welding or bolting the structure as in the previous embodiment.

Figure 1C:
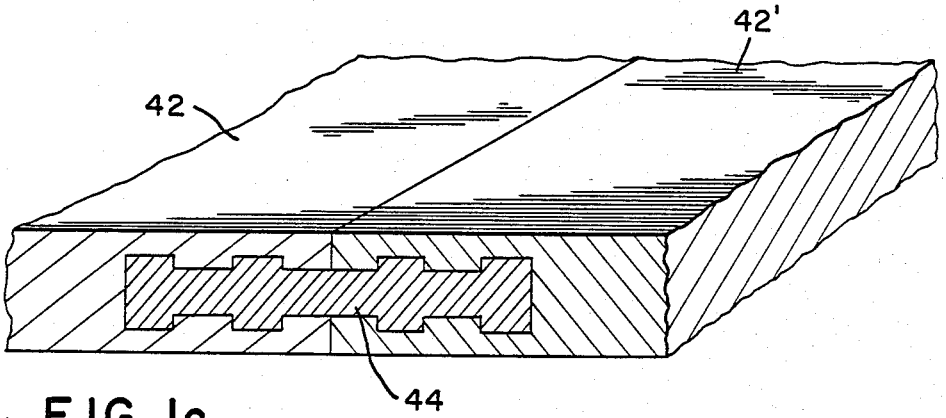
FIG. 1C an enlarged, fragmentary perspective view of still another embodiment of a papermakers fabric in accordance with the present invention.
Figure 1D:
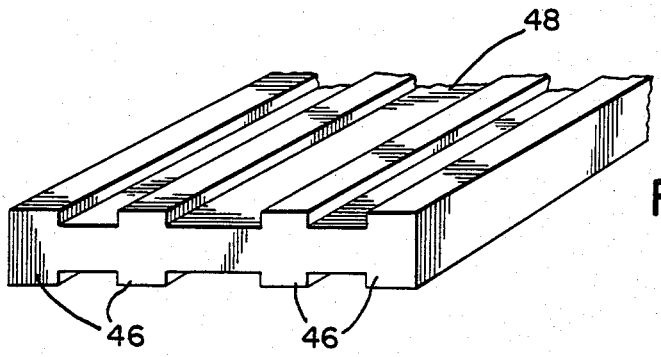
FIG. 1D is a fragmentary perspective view of one form of pintle which can be used to link the extruded, slotted elements shown in FIG. 1C.

A third embodiment is illustrated in FIG. 1C. In this embodiment adjacent slotted elements 42 and 42' are linked by a more intricate pintle structure 44. Pintle 44 is illustrated in greater detail in FIG. 1D and comprises an elongated extruded element which can be made from a synthetic material with a plurality of ridges 46 extending perpendicularly from each of the upper and lower faces, relative to the main body 48 of the pintle. Each ridge 46 can have a rectangular cross section and is linked at its mid-point by the transverse main body 48 of the pintle which also can have a rectangular cross section. In FIGS. 1C and 1D, a pintle with four ridges is shown, such a pintle providing greater strength in the machine direction, although other pintle cross sections can also be employed, if desired.

A papermakers fabric constructed using any of the slotted elements and pintles hereabove described will increase the ease with which a new fabric may be installed and will reduce the total paper machine down time required for such installation. Further, a fabric made of a series of linked elements as herein described will allow such a fabric to be readily maintained by permitting the removal and replacement of only those portions of the fabric which are damaged, and without the need to remove the entire fabric from the machine.

Installation of the fabric is accomplished as follows. First, the pintle or an element of the old papermakers fabric is removed at a convenient location on the paper machine. The new fabric will be moved to the paper machine in the form of a roll of the prelinked elements. The new fabric will be joined to the old fabric by a suitable connecting pintle (not shown) and the old fabric advanced through the paper machine and rolled up from the disconnected end, which will cause the new fabric to be pulled around the machine into position. Once the new fabric is in position, the connecting pintle will be removed and the final linking pintle inserted into the fabric to complete the installation.

A similar procedure can be followed for replacing a small section of the fabric. For such a replacement, pintles or slotted elements can be removed from either side of the fabric at a damaged area and a new piece of fabric, comprising several linked elements of the correct size, inserted.

It is important for papermakers fabrics to be permeable to a predetermined degree so that water can drain from the filter-water slurry during the formation of the paper and so that air and moisture can circulate freely during the drying operation. In order to create the required permeability in the extruded slotted papermaking fabric of the present invention, aperture can be provided in the extruded elements. The apertures can be formed by conventional laser drilling, or other methods, at selected locations over the surface of the fabric. Once a determination has been made as to the degree of permeability required in the fabric, the shapes of apertures to be created and their pattern can be selected to obtain the requisite degree of permeability.

Figure 2A:
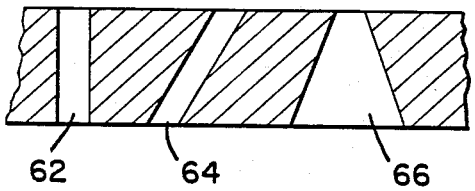
FIG. 2A is a fragmentary cross-sectional view of several forms of possible aperture configurations which can be employed in the papermakers fabric in accordance with the present invention.
Figure 2B:
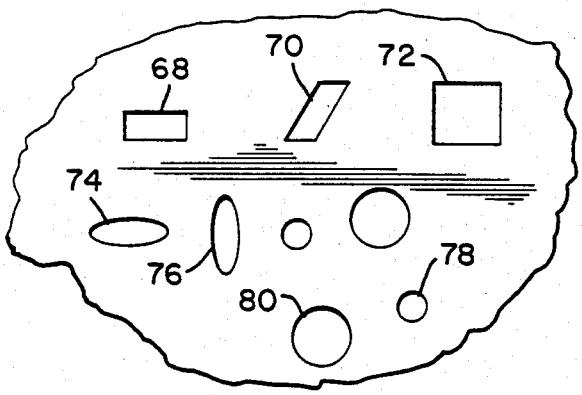
FIG. 2B is a fragmentary plan view of a portion of the papermakers fabric in accordance with the present invention and showing the different sizes and shapes of apertures that can be provided therein.

FIGS. 2A and 2B illustrate several forms of apertures that can be formed in the extruded elements, including apertures of cylindrical cross section such as 62, having their axes perpendicular to the upper and lower surfaces of the fabric, apertures of cylindrical cross section such as 64, formed at an oblique angle to the upper and lower surfaces of the fabric, or apertures such as 66, which are non-cylindrical, either increasing in diameter or decreasing in diameter from the upper surface to the lower surface of the fabric. In addition, apertures 68 that are rectangular in cross section, apertures 72 that are square, apertures 70 forming parallelograms, and apertures 74 forming ellipses or other non-circular openings 76 in the surface can also be provided. As can be seen, apertures of almost any desired or convenient cross section and orientation can be formed. In any one section of fabric there may be several different sizes and shapes of apertures, for example, a series of small apertures 78 in close proximity to a series of larger apertures 80, in whatever combination may be necessary to produce a required degree of permeability.

A further and significant benefit of the present invention is the ability to accurately vary the permeability of the fabric across the width of the fabric in accordance with a predetermined permeability profile. Current woven fabric technology is such that several weaving techniques are available to vary the permeability across the fabric width. However to date each causes an increase in weight in the low permeability area. This coupled with the changes in yarn loadings or yarn crimp may result in reducing fabric stability. Changing permeability by the addition of resin also increases fabric weight, but does not change the loading or crimp in the yarn. However, the reduction in the permeability by extra resin is generally less than in the case of using additional yarns.

Figure 3:
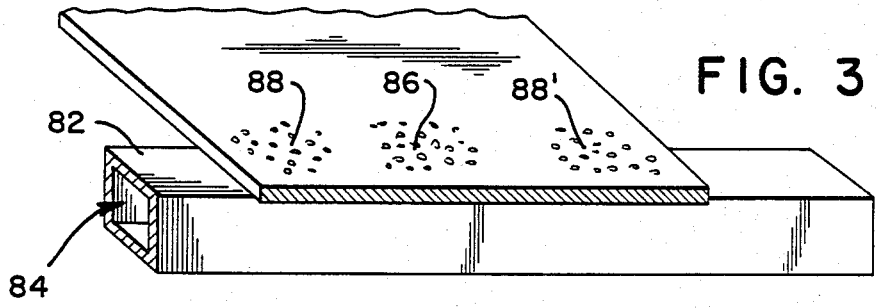
FIG. 3 is a fragmentary perspective view, partially in section, showing a portion of a fabric according to the present invention with varying permeability and with a vacuum box positioned thereunder.

The use of extruded elements with predetermined permeability allows the fabric to be structured in accordance with the requirements of the production process. For example, if a forming fabric is desired which has greater permeability and hence, more drainage near the outer edges of the belt than at the center, the aperture size, shape and pattern can be created to accomplish that drainage profile. Such a fabric is illustrated in FIG. 3. The fabric 82 is shown supported on a paper machine vacuum box 84. The center 86 of the fabric can be provided with apertures of smaller diameter, or apertures of the same size but having a larger spacing than at the edges 88 and 88' of the fabric, which will provide a more open structure at the edges of the fabric. Greater open hole structures will provide increased drainage in this area, or less friction. Production of a permeable fabric includes formation of drainage apertures comprising holes of different sizes, shapes and frequency across the extruded element which are created to control de-watering (wet felts) and to control permeability (dryer fabric). Additionally, the apertures can be placed so that fabric cleaning can occur and drainage characteristics can be changed by placing added tension on the extruded elements thus distorting or enlarging the drainage apertures.

Figure 4A:
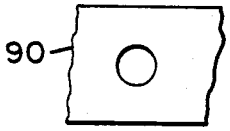
FIG. 4 illustrates the effect of a fabric tension on the geometry of the apertures in papermakers fabrics in accordance with the present invention.
Figure 4B:
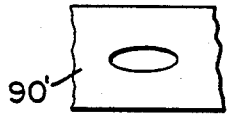

The use of extruded elements made from synthetic materials also allows the formation of fabrics in which the permeability can be adjusted while the fabric is on the machine and which also provide for self-cleaning features. As shown in FIG. 4, an aperture 90 can be formed with, for example, a circular cross section. If it is desired to increase the permeability of the fabric, increased tension can be applied to the fabric, causing the apertures to expand into the elliptical shape 90'. The expanded shape 90' will allow more water to pass through the fabric. A further advantage of this structure is that by applying tension to increase the aperture size as shown in FIG. 4, any dirt or debris which has clogged the holes will tend to be loosened and flushed away, thereby accomplishing the cleaning of the fabric apertures without removing the fabric from the machine or subjecting it to separate cleaning processes.

Figure 5:
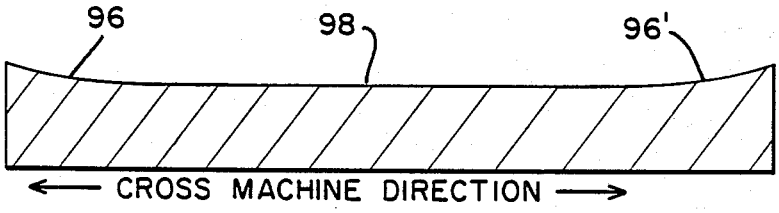
FIG. 5 is a transverse cross section of a papermakers showing, in an exaggerated matter, the variation in thickness in one embodiment of the present fabric.

The extruded elements can also be formed in a manner to improve the wear characteristics of the papermakers fabric edges when viewed across the machine. The fabric of extruded elements shown in FIG. 5 at 94 can be manufactured with greater thickness in areas of high wear at the edges 96, 94' than at the center 98. By adding material at these locations the fabric will have an increased useful life on the machine, thus being more economical in use. Such modification of the extruded element structure can also be accomplished to compensate for roll crown, where the roll has a larger diameter at the center than it does at the ends.

Figure 6A:
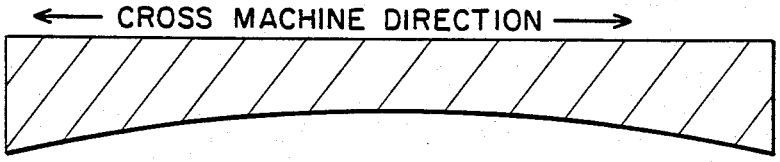
FIG. 6A is a cross-sectional view, exaggerated for ease of illustration, of a form of papermakers fabric formed according to the present invention.
Figure 6B:
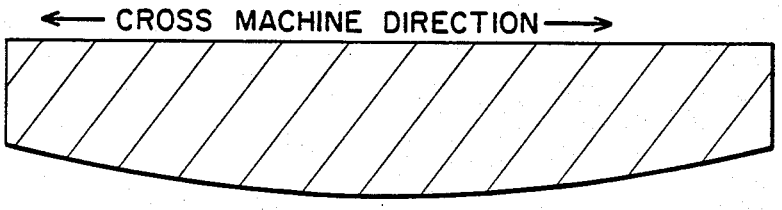
FIG. 6B is a cross-sectional view, exaggerated for ease of illustration, of a second embodiment of a papermakers fabric formed to conform to the roll crown which may be present on papermaking machine rolls.

The fabric cross section shown in FIG. 6A has a slightly concave lower surface in order to compensate for a convex carrier roll. Similarly, the fabric cross section shown in FIG. 6B has a convex lower surface to compensate for a roll which has ends of a larger diameter than the center.

Through the use of extruded elements and linking means it is possible to repair a papermakers fabric while it remains in the position of intended use on the paper machine. The damaged element or element section may be repaired by detaching the defective section and replacing it with a new element section. A sectional repair will reduce machine lost production time and will be more economical since only a portion of the fabric is being replaced.

Although the present invention has been shown and described in terms of particular embodiments, it will be appreciated by those skilled in the art that changes or modifications are possible which do not depart from the inventive concepts described herein. Such changes and modifications are deemed to fall within the purview of these inventive concepts and it is intended to encompass within the appended claims all such changes and modifications that fall within the scope of the present invention.

What is claimed is:

1. A papermakers fabric comprising:

a plurality of formed elongated elements of generally rectangular cross section having a length commensurate with the width of the desired fabric, said elements being positioned with their longitudinal axes oriented in the cross-machine direction and having substantially parallel flat upper and lowe surfaces, a first slot formed in and extending completely along at least one longitudinal edge of each of said elements, a second slot formed in and extending completely along another longitudinal edge of each of said elements, said element being formed with equivalently dimensioned slots on two opposite sides thereof, a first aperture pattern formed in and extending through the upper and lower surfaces of said elements to provide a given permeability of the fabric, connecting means for linking said plurality of elements one next to the other by means of said slots to form either an endless or an open ended fabric as required, said connecting means including a pintle formed to fit into said slots and thereby join adjacent formed elements, wherein the linked elements form a smooth papermaking fabric with no protrusions on either the upper or lower surfaces thereof and with no substantial gaps between the elements.

2. A papermakers fabric as set forth in claim 1 wherein said elongated elements have a uniform cross section along their longitudinal axis.

3. A papermakers fabric as set forth in claim 1 wherein said elements are of laminated construction.

4. A papermakers fabric as set forth in claim 1, wherein said first aperture pattern is formed in said elongated elements to provide a fabric having a given first permeability, and a second aperture pattern formed along the lateral edges of said elongated elements to provide a fabric having a permeability at the lateral edges thereof which is greater than said first permeability.

5. A papermakers fabric as set forth in claim 1 wherein an aperture pattern of given permeability is provided in said fabric, the permeability of which may be increased or decreased by changing the tension on the fabric.

6. A papermakers fabric as set forth in claim 1 wherein said elongated elements have a greater thickness at the ends forming the outer lateral edges of the fabric than at the center of the fabric.

7. A papermakers fabric as set forth in claim 1 wherein said linking means are retained in position by deforming the ends thereof after said elements have been linked together.

8. A papermakers fabric for use on paper machines comprising:

a plurality of extruded elongated elements of generally rectangular cross section having a length substantially equal to the desired cross machine width of the papermakers fabric, said elements being positioned with their longitudinal axes oriented in the cross-machine direction and having substantially parallel, flat upper and lower surfaces;

at least one slot formed in and extending completely along a longitudinal edge of each of said elements;

means for linking a plurality of said elements one next to the other by means of the slots formed in said elements, wherein the linked elements form a smooth papermaking fabric with no protrusions and having no substantial gaps between the elements; and said elements having a plurality of apertures extending through the upper and lower surfaces thereof, the cross-sectional areas of which apertures are different in the center of the fabric than at the edges thereof so that the permeability of the resulting papermakers fabric is different in the center of the fabric than it is at either edge, and wherein said permeability can be adjusted by changing the tension in the belt in the machine direction.

9. A papermakers fabric as set forth in claim 8 wherein said linking means comprises a tongue formed as integral part of each of said elongated elements; and wherein said elements include a slot formed on the side of the element opposite the side on which said tongue is formed;

and wherein said linking occurs by insertion of said tongue of one element into said slot of an adjacent element repetitively to form said endless or open ended fabric.

10. A papermakers fabric as set forth in claim 8 further comprising a second slot, said element being formed with equivalently dimensioned slots on two opposite sides, and wherein said linking means comprises a pintle formed to fit into said slots and thereby join adjacent formed elements.

11. A papermakers fabric as set forth in claim 8 wherein said elements are formed from laminated material.

12. A papermakers fabric as set forth in claim 8, wherein the apertures at the lateral edges of said fabric have a greater cross-sectional area than the apertures in the center of the fabric to provide a fabric having a permeability greater at the lateral edges thereof than in the center thereof.

13. A papermakers fabric as set forth in claim 8 wherein said elongated elements are formed with greater thickness at the ends forming the outer lateral edges of the fabric than at the center of the fabric.

14. A papermakers fabric as set forth in claim 8 wherein said linking means are retained in position by deforming the ends thereof.

* * * * *